US005081778A

United States Patent [19]

Switzer

[11] Patent Number: 5,081,778

[45] Date of Patent: Jan. 21, 1992

[54] CARTRIDGE CLIP

[76] Inventor: Robert D. Switzer, 2200 N. Ft. Thomas Ave., Ft. Thomas, Ky. 41075

[21] Appl. No.: 535,787

[22] Filed: Jun. 11, 1990

Related U.S. Application Data

[62] Division of Ser. No. 413,279, Nov. 9, 1989, Pat. No. 4,995,179.

[51] Int. Cl.[5] ..... F41A 9/25

[52] U.S. Cl. ..... 42/50

[58] Field of Search ..... 42/50, 87; 89/33.1

[56] References Cited

U.S. PATENT DOCUMENTS

| | | | |
|---|---|---|---|
| 2,137,491 | 11/1938 | Huff | 42/50 |
| 2,383,998 | 9/1945 | Vesely | 42/50 |
| 2,620,061 | 12/1952 | Uxa | 206/42 |
| 2,620,582 | 12/1952 | Stukas | 42/50 |
| 2,828,568 | 4/1958 | Sakewitz | 42/50 |
| 2,862,324 | 12/1958 | Ball | 42/50 |
| 2,885,811 | 5/1959 | Womble, Jr. | 42/50 |
| 2,910,795 | 11/1959 | Agren | 42/50 |
| 3,443,334 | 5/1969 | Ardolino | 42/50 |
| 3,453,762 | 7/1969 | Fremont | 42/50 |
| 4,430,821 | 2/1984 | Vincent | 42/50 |
| 4,905,394 | 3/1990 | Predazzer | 42/50 |

FOREIGN PATENT DOCUMENTS 747658 1/1944 Fed. Rep. of Germany .

*Primary Examiner*—Stephen C. Bentley
*Attorney, Agent, or Firm*—Wood, Herron & Evans

[57] ABSTRACT

A cartridge clip having a mechanism which permits the compression force of the clip's spring to be relieved when reloading the clip. The mechanism, in preferred form, includes a door frame connected to the magazine's closed end, an access door mounted to that door frame which is movable between open and closed positions, and a spring seat within which the compression spring is received. The spring seat is telescoped interiorly of the magazine when the access door is closed to provide the requisite compression spring force for ejection of cartridges from the magazine's ejection end. The spring seat is telescoped exteriorly of the magazine to a predetermined outside position when the door is opened so as to relieve that spring force for permitting additional cartridges to be loaded into the magazine's ejection end.

16 Claims, 8 Drawing Sheets

CARTRIDGE CLIP

This is a division, of application Ser. No. 07/413,279, filed Nov. 9, 1989, now U.S. Pat. No. 4,995,179.

This invention relates to guns. More particularly, this invention relates to an improved cartridge clip for guns.

Guns, particularly handguns such as pistols, are commonly structured to receive cartridge clips. The cartridge clip carries a series of cartridges or bullets, and is adapted to feed those bullets one at a time in succession to the gun's firing chamber. This cartridge clip approach to handguns allows a handgun to fire a series of cartridges, e.g., six or eight or more, without need for hand loading cartridges one at a time to the gun. And the cartridge clip allows plural cartridges, e.g., six or eight or more, to be easily loaded in proper firing sequence with the gun simply by loading a single clip into the gun.

The basic structure of a cartridge clip includes a magazine with an ejection end and a closed end in combination with a compression spring positioned within that magazine. The cartridges are loaded sequentially within the magazine against the compression force exerted by the spring. Once loaded in the magazine, the cartridges are spring-loaded toward the ejection end for subsequent ejection therefrom when the clip is loaded in a gun.

A substantial compression spring force must be available in a cartridge clip, in order to properly move a succeeding cartridge in sequence to the magazine's ejection end after a preceding cartridge has been ejected from the magazine. When the magazine is reloaded, i.e., after all cartridges have been ejected from the magazine, the compression spring must be compressed sequentially in response to the loading of each individual cartridge until the clip's maximum cartridge supply is received. Now the more cartridges that are put into the clip, the greater the resistance of the compression spring against further compression. And this means that the last cartridge loaded into the magazine is significantly harder to load than the first cartridge loaded into the magazine.

Therefor, it has been the primary objective of this invention to provide an improved cartridge clip in which the compression force exerted by the compression spring interiorly of the clip's magazine can be reduced significantly when reloading of the clip is desired, such being accomplished by permitting the clip's compression spring to expand substantially beyond its interior restricted length. In accord with this object, applicant's invention contemplates, in preferred form, a spring relief kit for a cartridge clip in which the magazine's closed end is compressed of a door frame attachable to that end, and an access door mounted on that door frame which is movable between a closed position where the magazine is operable to eject cartridges loaded in the clip and an open position where the compression spring length can be significantly extended to relieve temporarily the compression spring force within the clip while loading additional cartridges within the magazine. A spring seat, within which one end of the compression spring is received, is telescoped inside the magazine when the door is closed and telescoped outside the magazine when the door is open. The spring seat cooperates with one of the door frame and the door to locate same in the outside position.

Other objectives and advantages of this invention will be more apparent from the following detailed description taken in conjunction with the drawing in which.

Figure 1:
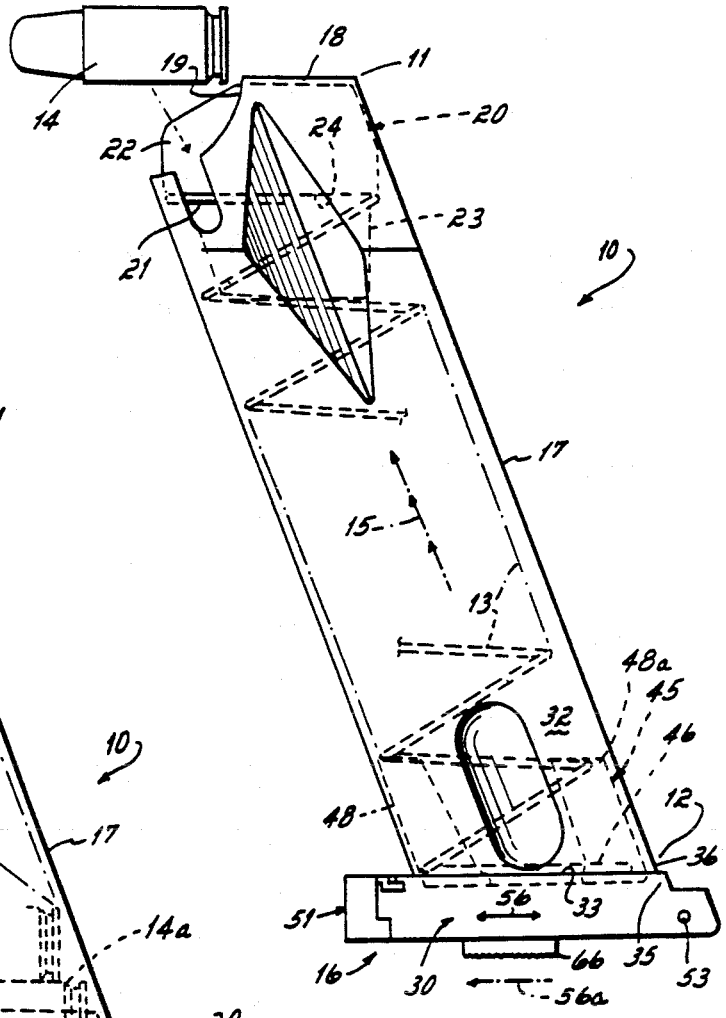
FIG. 1 is a side elevation view of a first embodiment of a cartridge clip in accord with the principles of this invention, the clip's door being illustrated in the closed position, and the clip's spring seat being in the use position where same is telescoped inside the clip's magazine, the clip having no cartridges therein.

A first embodiment of a cartridge clip in accord with the principles of this invention is illustrated in FIGS. 1–10. The cartridge clip basically includes a magazine 10 with an ejection end 11 and a closed end 12. A compression spring 13 is positioned within the magazine 10, cartridges 14 that are loaded into the magazine being spring-loaded in the direction shown by phantom arrow 15 toward the magazine's ejection end 11 for subsequent ejection therefrom when the clip is installed with a gun (not shown). The magazine's closed end 12, in this first embodiment, is provided with a spring relief kit 16 the component parts of which are particularly illustrated in FIG. 3.

Figure 2:
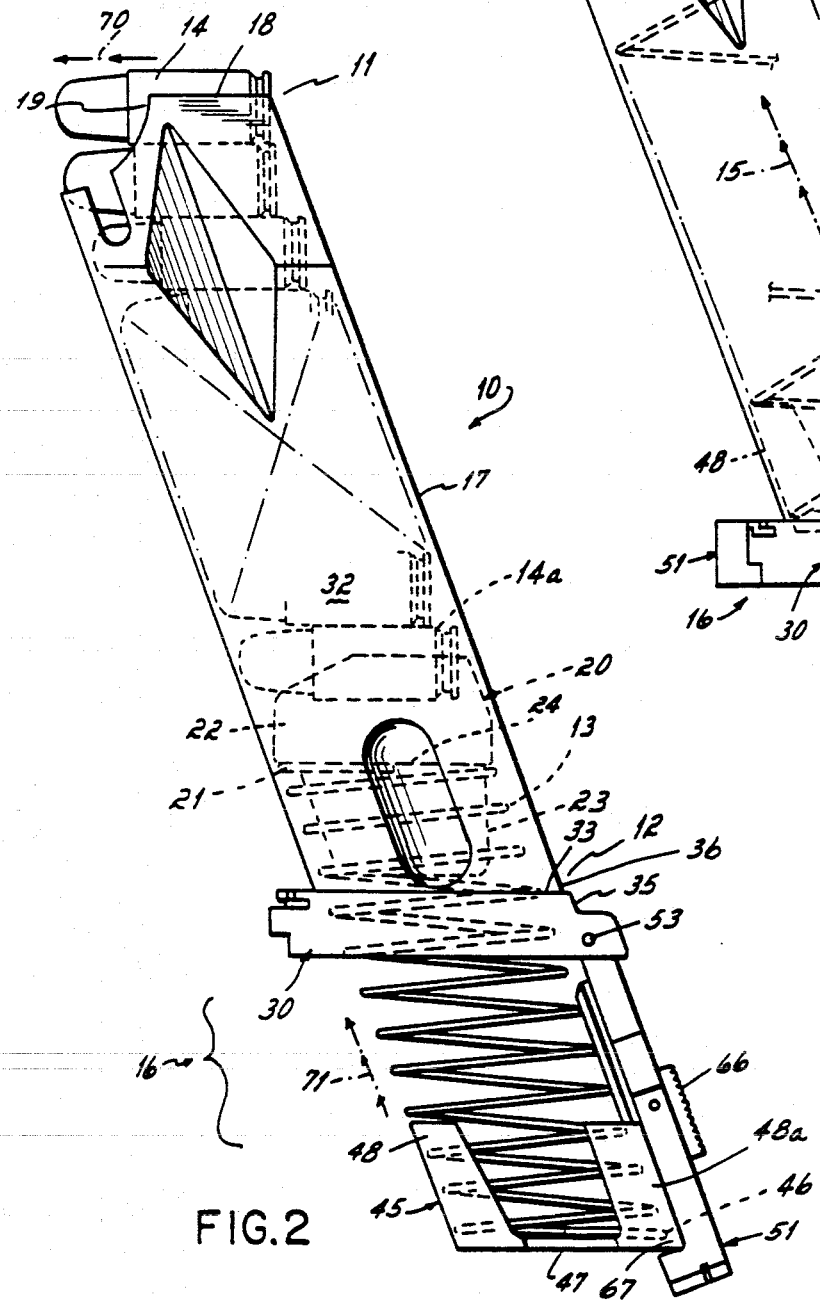
FIG. 2 is a side elevation view similar to FIG. 1, but illustrating the clip's door in the open position and the clip's spring seat in the reload position where same is telescoped outside the clip's magazine, the clip being reloaded with cartridges.
Figure 3:
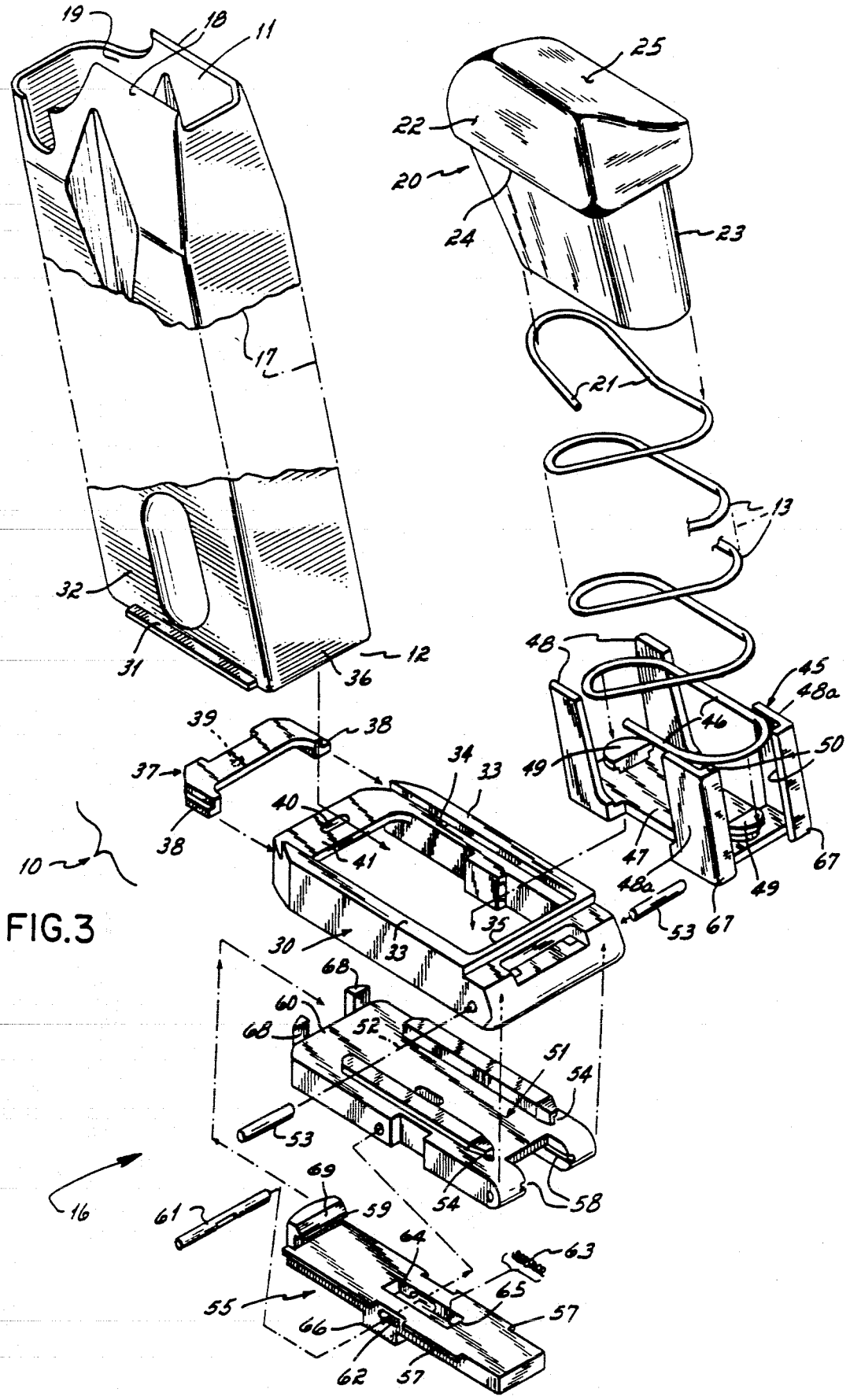
FIG. 3 is an exploded perspective view illustrating the various components of the cartridge clip shown in FIGS. 1 and 2.
Figure 4:
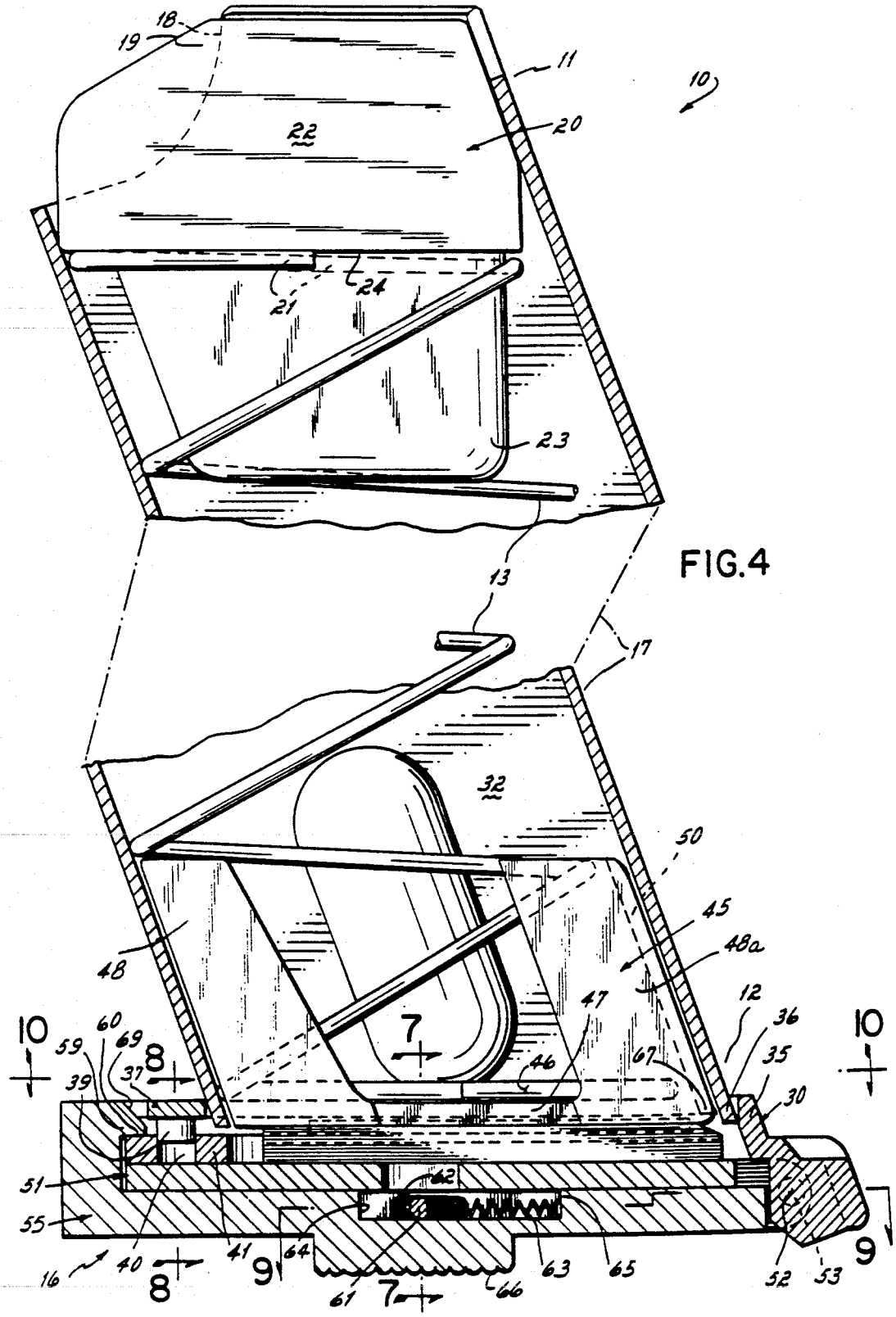
FIG. 4 is a cross sectional side elevation view of the cartridge clip illustrated in FIG. 1.
Figure 5:
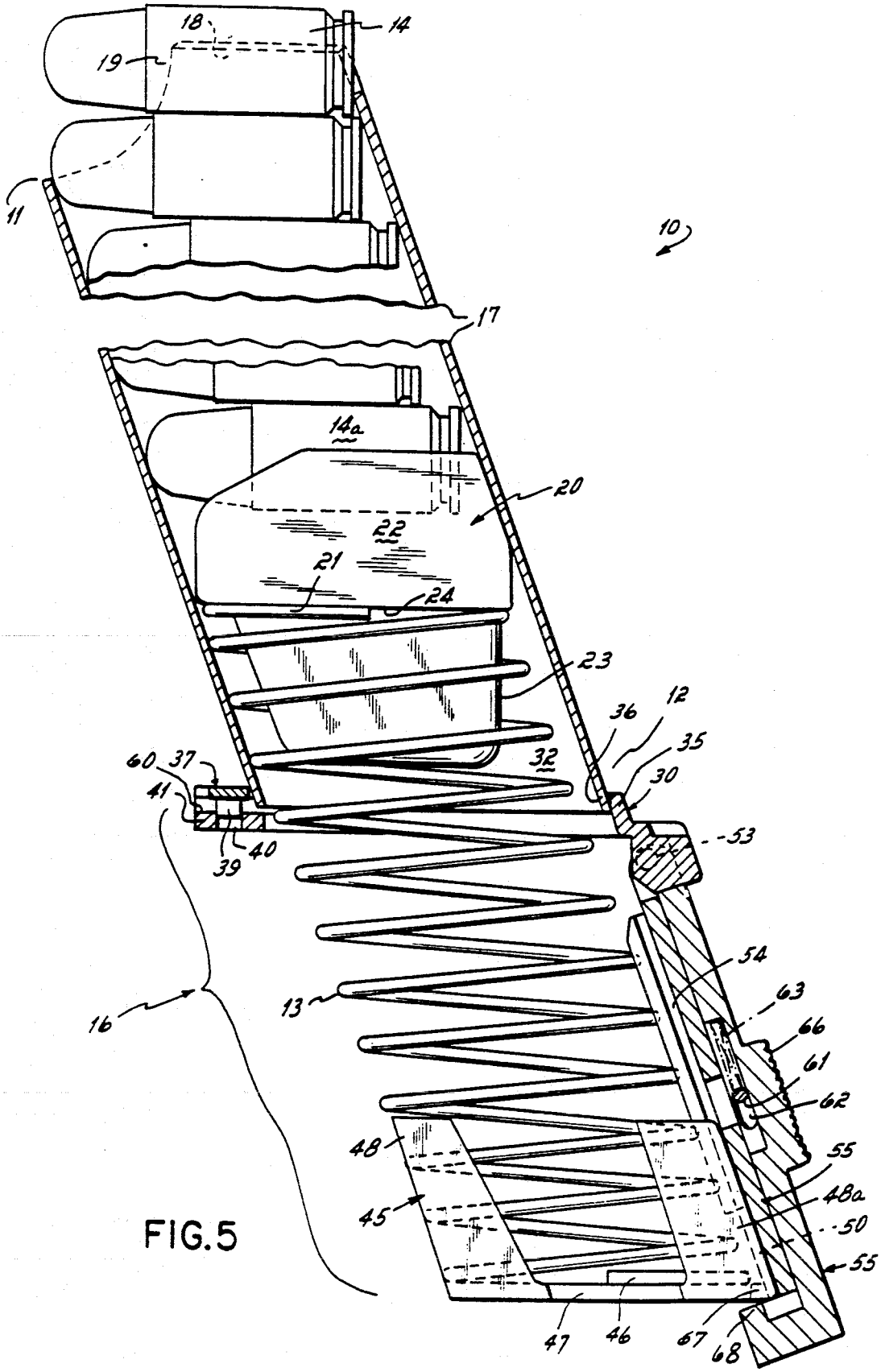
FIG. 5 is a cross sectional side elevation view similar to FIG. 2.

The magazine 10 is in the form of a tubular housing 17 having an open end 11 with flared side walls 18 that neck down to define an ejection slot 19 at the open end. The compression spring 13 is in the form of a coil spring which seats a cartridge follower 20 in its top loop 21. The cartridge follower 20 is comprised of a follower block 22 and a stem 23, the stem being received in top loop 21 of the compression spring 13. The follower 20 includes a seat 24 defined by the stem 23 and the follower block 22 against which the spring's top loop 21 is seated. The follower 20 also includes a formed upper surface 25 against which the lowest cartridge 14*a* in a stack of cartridge within the clip rests when the clip is full as shown in FIG. 2.

The spring relief kit 16 is comprised of door frame 30 slideably received on lips 31 fixed to the magazine's side walls 32 at the closed end 12 thereof. The door frame 30 includes top rails 33 which define grooves 34 which slide over the magazine's lips 31, the door frame being properly positioned relative to the magazine housing when end surface 35 of the door frame abuts end wall 36 of the housing 17. A frame retainer 37 is slip fit into the open end of the door frame's rails 33 in order to hold the door frame 30 in assembled relation with the magazine 10. The frame retainer 37 includes lip sections 38 which interfit within grooves 34 formed by the door frame's rails 33 so as to retain the door frame 30 in assembled relation with the housing 17 at the closed end of the magazine 10. The frame retainer 37 includes a latch dimple 39 which interfits with a dimple bore 40 in the end 41 of the door frame 30 when the door frame is assembled with the housing 17.

A spring seat 45 receives end loop 46 of the compression spring 13. The spring seat 45, as shown particularly in FIG. 3, includes a floor 47 and a telescope arm 48 at each corner thereof. The floor 47 mounts spring positioner/retainer stubs 49 at opposite ends thereof, the end coil loop 46 of the compression spring being adapted to interfit around these stubs so as to hold same in assembled relation with the spring seat 45. The two rear telescope arms 48*a* each include an inwardly disposed guide lip 50 for purposes described below. The spring seat's guide arms 48 permit the spring seat 45 to be guided as it is telescoped inside of the magazine 10 (as shown in FIG. 1), and to be guided as it is telescoped outside of of the magazine (as shown in FIG. 2) as it moves between clip use and clip reload positions.

An access door 51 is pivotally mounted to door frame 30 on pivot axis 52 by pivot pins 53. The access door 51 includes a pair of parallel guide tracks 54 on which the spring seat 45 slides as discussed in further detail below. The access door 51 also includes a latch slide 55 which is slideable relative to the door, as shown by phantom arrow 56, to permit latching and unlatching of the access door relative to the door frame 30. The latch slide 55 includes ribs 57 on opposite side edges thereof received in groves 58 defined in opposite sides of the access door 51. The latch slide 55 also includes a latch 59 at one end adapted to interfit over strike surface 60 at the end of the door frame 30 when the spring relief kit 16 is assembled with the magazine 10. The latch slid 55 is held in slideable relation with the access door 51 by a door pin 61 fixed to the door at opposite ends thereof, that door pin being encaptured in the latch slide's lost motion slot 62. A latch spring 63 is interposed in the latch slide's center slot 64 between the door pin 61 and slot end 65 so that the latch spring is compressed when the latch slide is slid in the unlatched direction shown by phantom arrow 56*a* in FIG. 1 through use of thumb rest 66. Accordingly, the latch slide 55 is continuously spring loaded to the latch position shown in FIG. 4.

Use of the first embodiment illustrated in FIGS. 1–10 is as follows. The empty position of the cartridge clip is shown in FIG. 1. This position is the case after all cartridges 14 have been ejected in the general direction illustrated by phantom arrow 70 while the cartridge clip is in operative assembly with a gun (not shown). With the cartridge clip removed from the gun, and with all cartridges 14 having been rejected therefrom, the access door 51 is first released and allowed to pivot or swing down to the open or loading position shown in FIG. 2. The access door 51 is released by initially pushing thumb rest 66 in the direction shown by phantom arrow 56*a*, this causing the latch slide's latch lip 59 to be disengaged from the latch edge 60 on the door frame 30. With the access door 51 swung into the FIG. 2 position, and because the compression spring 13 within the magazine 10 is still not fully relieved even though the magazine is empty, the compression spring pushes the spring seat 45 outside of the magazine into the FIG. 2 position.

When the compression spring 13 and spring seat 45 are telescoped exteriorly of the housing, the spring seat's lips 50 on the rear guide arms 48*a* interconnect with the access door's guide tracks 54 so that the spring seat is properly guided into its outermost position as shown in FIG. 2. In other words, this first embodiment includes a guide assembly partially carried by the access door 51 and partially carried by the spring seat 45 to guide the spring seat as it moves between its telescoped position inside the magazine 10 as shown in FIG. 1 and its telescoped position outside the magazine as shown in FIG. 2. This guide assembly is comprised of guide rails 54 on the access door 51, and guide lips 50 on the spring seat 45, same operably interfitting to guide the spring seat in its telescoping or reciprocal motion between its use and reload positions.

In the spring seat's outermost position, the spring seat's rear edge 67 cooperates with the access door's posts 68 and latch lip 59 to position or locate the spring seat in that outermost position. In other words, a drop out limit device, which is partially carried by the magazine 10 and partially carried by the spring seat 45, limits the telescope outside position of the spring seat. In this first embodiment, that drop out limit device is comprised of a limit stop 59, 68 carried on the access door 51 and a limit stop 67 carried on the spring seat 45, these two limit stops interacting at the outermost position of the spring seat to define that position.

Figure 6:
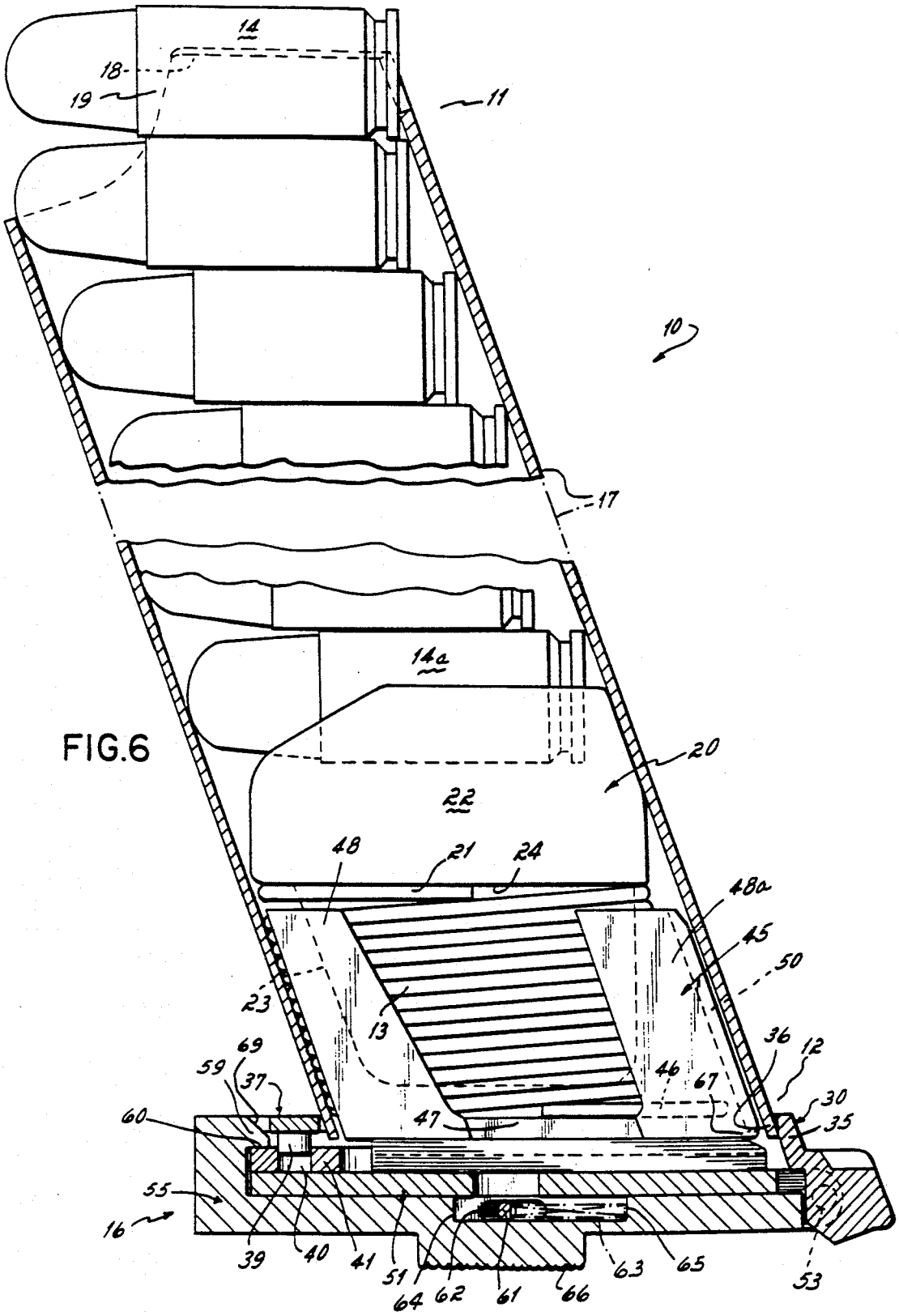
FIG. 6 is a cross sectional side elevation view similar to FIG. 5 but with the clip's door closed so that cartridge clip is operational.
Figure 7:
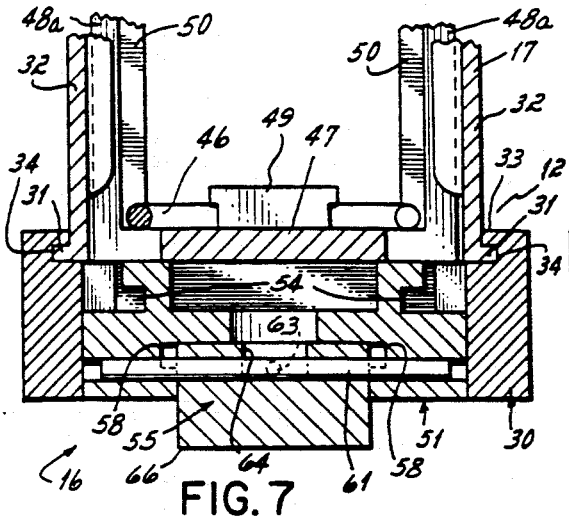
FIG. 7 is a cross sectional view taken along line 7—7 of FIG. 4.
Figure 8:
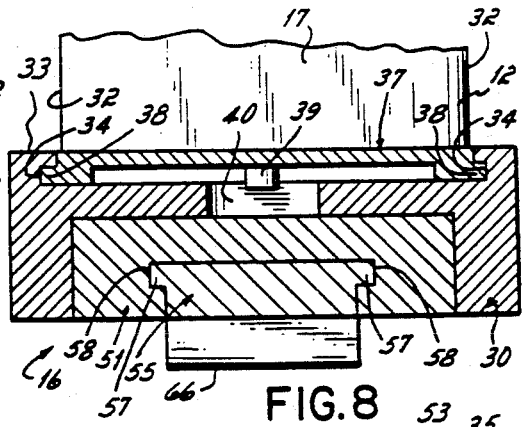
FIG. 8 is a cross sectional view taken along line 8—8 of FIG. 4.
Figure 9:
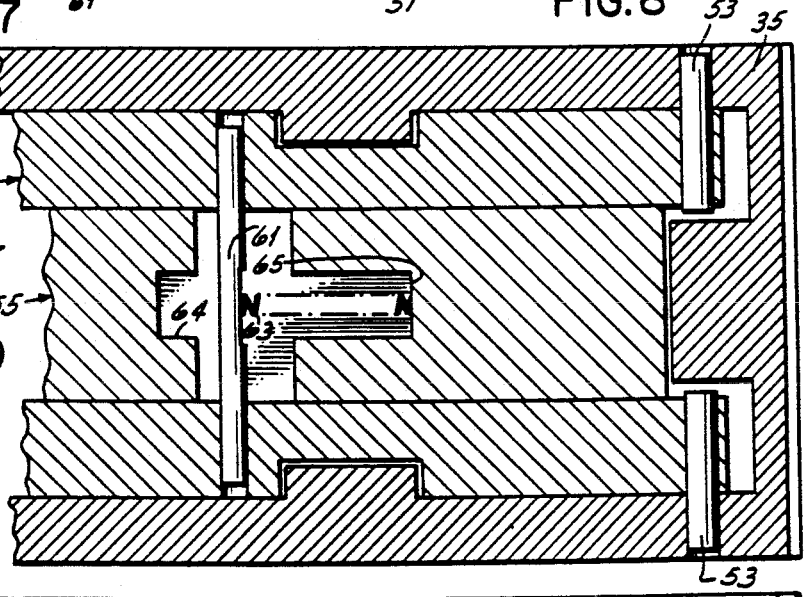
FIG. 9 is a cross sectional view taken along line 9—9 of FIG. 4.
Figure 10:
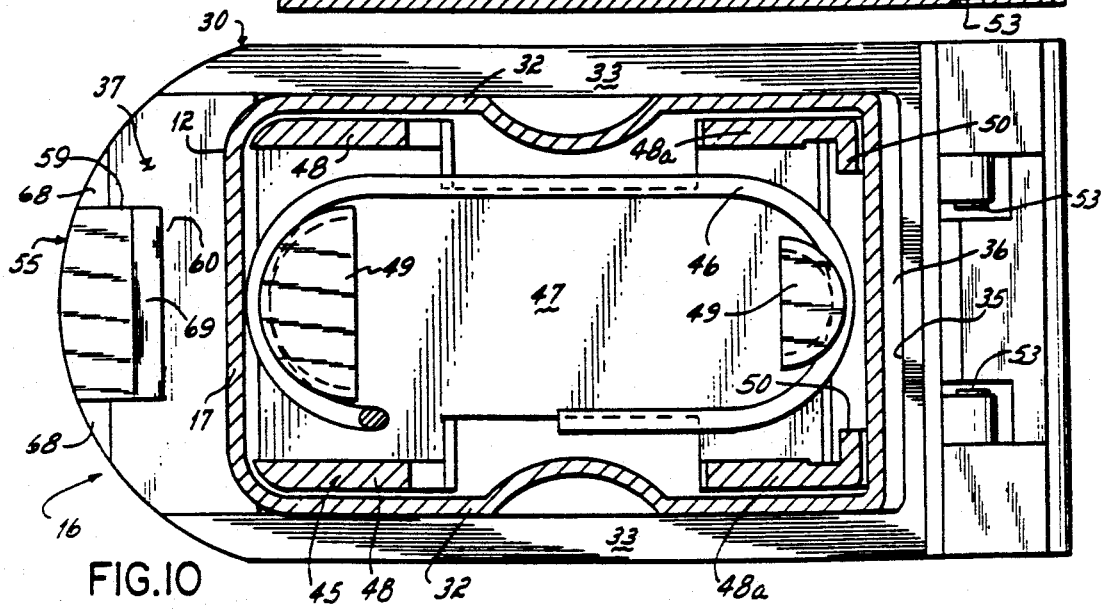
FIG. 10 is a cross sectional view taken along line 10—10 of FIG. 4.
Figure 11:
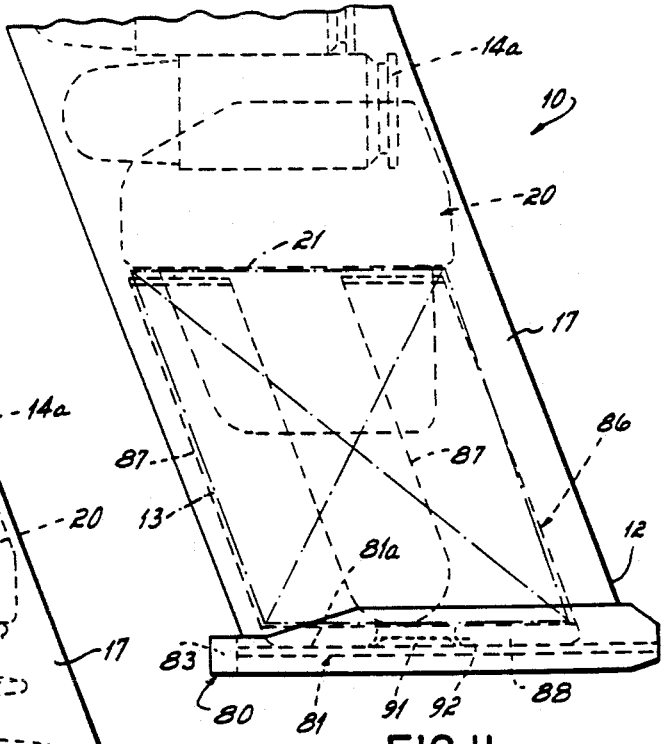
FIG. 11 is a side elevation view of a second embodiment of a cartridge clip in accord with the principles of this invention, the clip's door being illustrated in the closed position, and the clip's spring seat being in the use position where same is telescoped inside the clip's magazine, the clip being fully loaded with cartridges.
Figure 12:
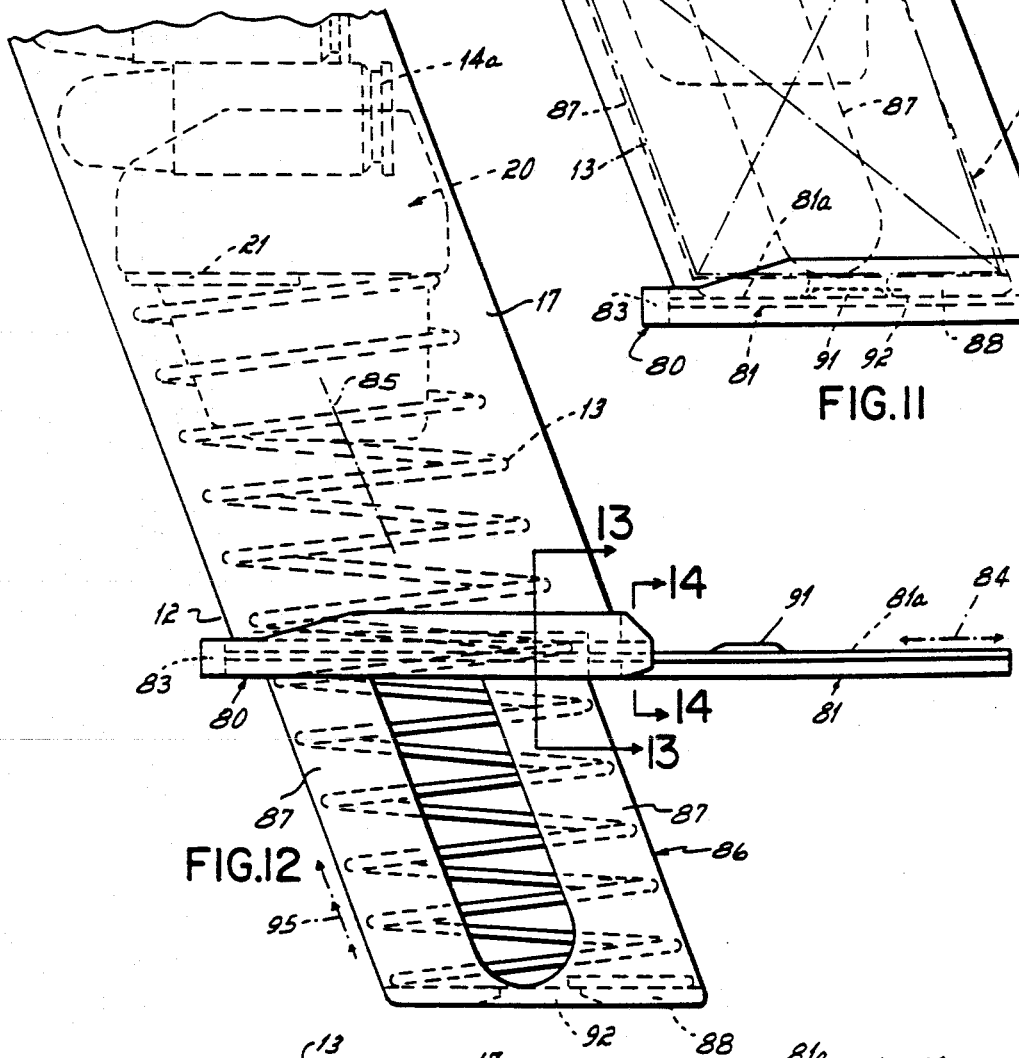
FIG. 12 is a side elevation view of the second embodiment illustrated in FIG. 11, the cartridge clip being shown in a reloading position with the access door open and the spring seat extended, the clip being partially reloaded with cartridges.
Figure 13:
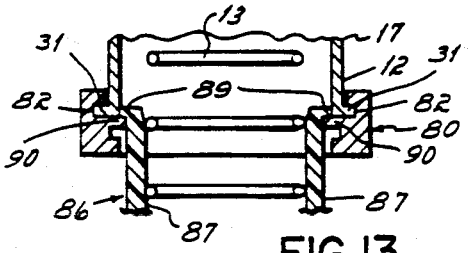
FIG. 13 is a cross sectional view taken along line 13—13 of FIG. 12.
Figure 14:
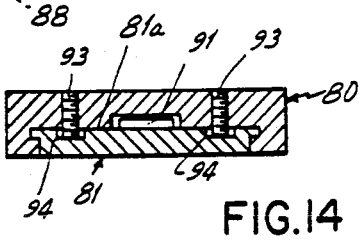
FIG. 14 is a cross sectional view taken along line 14—14 of FIG. 12.

With the spring seat 45 in the telescope out position shown in FIG. 2, the compression spring 13 is lengthened relative to its available length when it is solely within the magazine 10. In this lengthened posture, the compressive force exerted by the spring 13 is materially lessened. And this, in turn, allows a full compliment of cartridges 14 to be loaded more easily into the magazine 10 from the ejection end 19 thereof. When a complete load of cartridges 14 has filled the magazine 10, the spring seat 45 is pushed upwardly or telescoped back into the magazine in a direction shown by phantom arrow 71 in FIG. 2. The spring seat 45 is so guided in its return movement by the interaction of the spring seat's lips 50 with the access door's tracks 54. With the spring seat 45 telescoped up into the magazine 10, the access door 51 is swung closed back into the FIG. 1 position. As the access door 51 is swung to the closed position, cam surface 69 on the latch slide's latch 59 cams that latch over the edge of the door frame's strike plate 60, thereby latching the access door 51 closed to the door frame 30. Now with the spring seat 45 telescoped within the magazine 10, the spring seat's floor 47 sits on top the tracks 54 fixed to the access door, with a maximum cartridge 14 load installed within the cartridge clip the compression spring 13 is compressed to its maximum extent, all as shown in FIG. 6.

A second embodiment of a cartridge clip in accord with the principles of this invention is illustrated in FIGS. 11–14. This second embodiment is comprised of a door frame 80 and an access door 81. The door frame 80 is provided with opposed grooves 82 which permits it to be received on lips 31 at the closed end of the magazine 10 as with the first embodiment. A frame retainer 83 is interconnected with the frame 80 after the frame is installed on the magazine's lips in order to hold it in operable combination, again as with the first embodiments.

Access door 81 of the second embodiment differs from access door 51 of the first embodiment. With access door 81, the door is slideable (see phantom arrow 84) between a closed position shown in FIG. 11 and an open position shown in FIG. 12. So door 81 slides in a plane disposed at an angle relative to axis 85 of compression spring 13.

A spring seat 86 for the second embodiment is provided with a series of four guide arms 87 and floor 88. The guide arms 87, at the top ends thereof, are each provided with an outwardly flared lug 89 that overlies a cooperating ledge 90 defined by the door frame 80. In the extended position illustrated in FIGS. 12 and 13, note that the spring seat's lugs 89 interengage the door frame's ledges 90 so as to limit or define the telescope out position of the spring seat 86 to that shown in FIGS. 12 and 13. The spring seat 86 is guided between its telescoped inside and outside positions by virtue of the spring seat's guide arms 87 interacting with the opening defined by the door frame 80 when the sliding door 81 is in the open position shown in FIG. 12.

The sliding door 81 is provided with a detent latch 91 on its inner surface that cooperates with latch bore 92 in the spring seat's floor 88. In other words, and when the sliding door 81 and latch seat 86 re in the closed or clip use position shown in FIG. 11, the sliding door's detent 91 is received in the spring seat's bore 92, and the spring seat 86 is spring loaded against the sliding door's inside surface 81*a* by virtue of the compression spring 13, thereby holding the door closed. The sliding door 81 is limited in its open position by stop screws 93 mounted in the door frame 80 that cooperate with slots 94 in the access door 81 so that the door cannot be pulled out of the door frame, see FIG. 14.

Use of the second cartridge clip embodiment illustrated in FIGS. 11–14 is basically the same as that of the first cartridge clip embodiment illustrated in FIGS. 1–10. In other words, and when all cartridges have been expended from the cartridge clip so that reloading is required, the access door 81 is slid open into the FIG. 12 position, the spring seat 86 being ejected into the telescope out position also shown in that figure by virtue of the compression forces exerted by compression spring 13. After a new load of cartridges has been installed into the cartridge clip in the fashion described above in connection with the first embodiment, the spring seat 86 is simply manually pushed back into the magazine 10 in the direction shown by phantom arrow 95 until it is wholly within the magazine, and the door is then slid closed. The access door 81 thus holds the spring seat 86 in its telescoped interior position within the magazine 10, and the latch bore 92 on the spring seat's floor 88 cooperates with the sliding door's detent 91 to hold the door closed.

Figure 15:
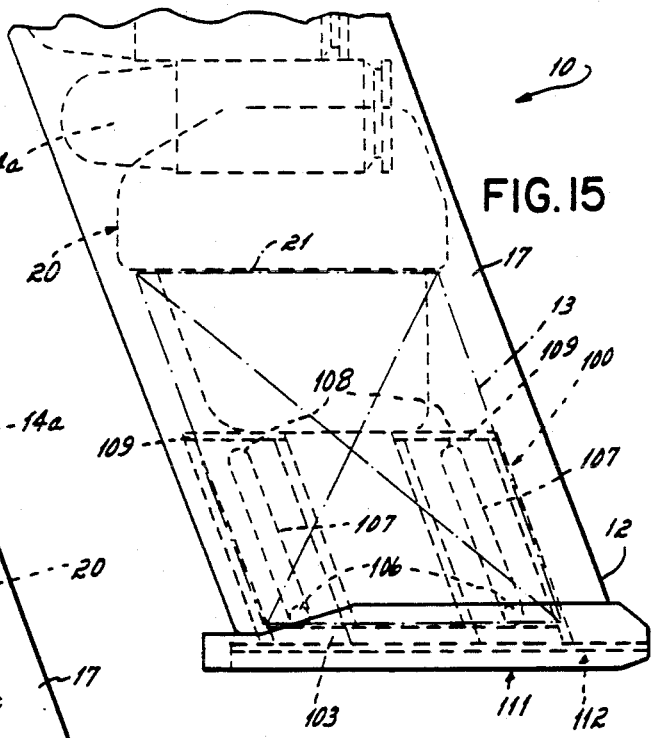
FIG. 15 is a side elevational view of a third embodiment of a cartridge clip in accord with the principles of this invention, the clip's door being shown in the closed position, and the clip's spring seat being shown in the use position where same is telescoped inside the clip's magazine, the clip being shown fully loaded with cartridges.
Figure 16:
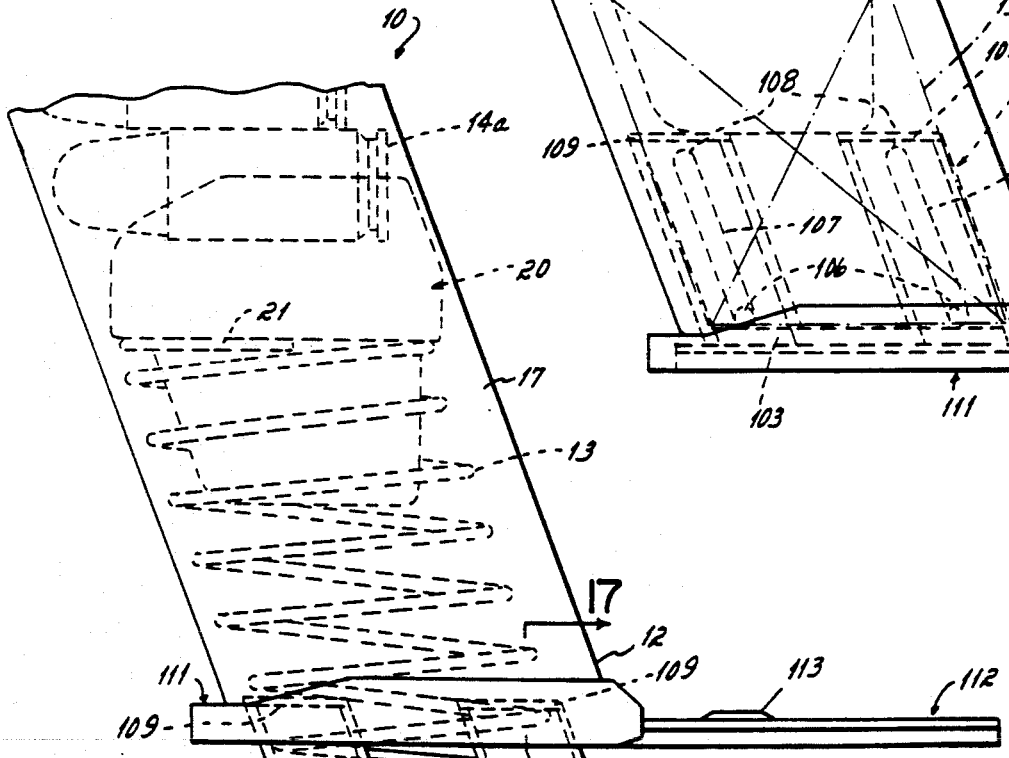
FIG. 16 is a side elevation view similar to FIG. 15 but illustrating the clip in the reload position with the access door open and the spring seat fully extended, the clip being partially reloaded with cartridges.
Figure 18:
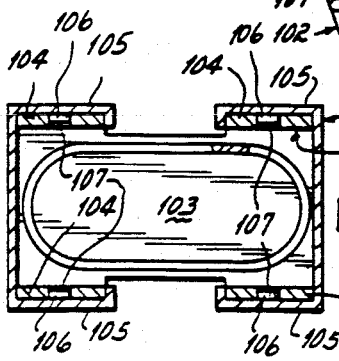
FIG. 18 is a cross sectional view taken along line 18—18 of FIG. 16.
Figure 17:
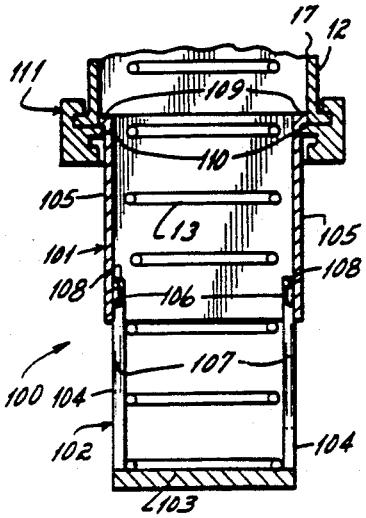
FIG. 17 is a cross sectional view taken along line 17—17 of FIG. 16.

A second alternative embodiment of a cartridge clip in accord with the principles of this invention is illustrated in FIGS. 15–18. This third embodiment is similar to the second embodiment except that the spring seat 100 structure is different. Specifically, and as shown in FIGS. 16–18, the spring seat 100 is comprised of an upper seat section 101 and a lower seat section 102. The lower seat section 102 includes a floor 103 and four arms 104 extending upwardly from the four corners thereof. The upper seat section 101 is comprised of four arms 105 but no floor, each of the upper seat section's arms being telescopably connected with a lower seat section's arm 104. Each pair 104, 105 of operably connected arms is held in interconnected relation by a pin 106 fixed to the upper arm 105 that slides in a slot 107 in the related lower arm 104. Each pin 106 interacts with top end 108 of slot 107 in lower arm 104 so as to define the outer limit of the lower seat section 102 relative to the upper seat section 101. Each upper seat section's arm 105 includes a seat lug 109 adapted to cooperate with a seat edge 110 defined by door frame 111 so as to hold the upper seat section's arms 101 in the desired outer attitude.

This third embodiment also includes a access door 112 that is slideable between a closed position shown in FIG. 15 and an open position shown in FIG. 16. The closed position of the door 112 relative to the magazine 10 is maintained by a detent 113 on the door's inside surface that cooperates with a detent bore 114 in the lower seat section of the latch seat, which is similar to the second embodiment.

Use of this third embodiment of the cartridge clip is the same as with the second embodiment with the exception that the spring seat itself is comprised of upper 101 and lower 012 sections which telescope relative one to the other. This telescoping action of the spring seat 100 components relative one to the other, as well as of the spring seat 100 relative to the magazine, provides a spring seat which takes up less room interiorly of the magazine 10 when the spring seat is received therein in clip use position as shown in FIG. 15.

Having described in detail the preferred embodiment of my invention, what I desire to claim and protect by Letters Patent is:

1. A cartridge clip comprising a magazine having an ejection end and a closed end, a compression spring positioned within said magazine, cartridges that are loaded into said magazine being spring biased toward the ejection end of said magazine for subsequent ejection therefrom, a spring seat within which one end of said compression spring is received, said spring seat being telescoped inside said magazine when said cartridge clip is in charged condition, and said spring seat being telescoped outside said magazine when said cartridge clip is in loading condition, said spring seat comprising an upper spring seat section and a lower spring seat section, said upper and lower sections being telescopable relative one to the other, said upper spring seat section allowing said compression spring to pass therethrough and said lower spring seat section being adapted to support one end of said compression spring.

2. A cartridge clip as set forth in claim 1, said clip comprising a drop out device partially carried by said magazine and partially carried by said spring seat, said drop out device functioning to limit the telescope out position of said spring seat, and said drop out device also functioning to limit the telescope out position of said two spring seat sections relative one to the other.

3. A cartridge clip comprising a magazine with an ejection end and a closed end, a compression spring positioned within said magazine, cartridges that are loaded into said magazine being spring loaded toward the ejection end of said magazine for subsequent ejection therefrom, an access door mounted at said magazine's closed end, said access door being slideable between open and closed positions, and said access door being slideable within a path angularly oriented relative to said compression spring's axis, a spring seat within which one end of said compression spring is received, said spring seat being telescoped inside said magazine when said door is closed and telescoped outside said magazine when said door is open, and a drop out limit device partially carried by said magazine and partially carried by said spring seat, said drop out limit device functioning to define the telescoped out position of said spring seat.

4. A cartridge clip as set forth in claim 3, said drop out limit device comprising at least one lug carried by one of said spring seat and said magazine, and at least one lip carried by the other of said spring seat and said magazine, said lug and lip interacting to restrict the telescope out position of said spring seat so as to define that spring seat's outermost position.

5. A cartridge clip as set forth in claim 3, said spring seat comprising an upper seat section and a lower seat section, said upper and lower sections being telescopable relative one to the other as said spring seat moves between its inside and outside positions relative to said magazine.

6. A cartridge clip as set forth in claim 5, said clip comprising a seat section limit device partially carried by said upper section and partially carried by said lower section, said seat section limit device functioning to limit the telescope out position of said seat sections relative one to the other.

7. A cartridge clip as set forth in claim 6, said seat section limit device comprising at least one pin fixed to one of said two sections, and at least one track formed in the other of said two sections, said pin and said track cooperating to guide the two sections in their telescoping movement relative one to the other.

8. A cartridge clip as set forth in claim 3, said clip comprising a latch operably connected between said door and said spring seat, said latch serving to maintain said door in its closed position.

9. A cartridge clip as set forth in claim 8, said latch comprising a latch detent on one of said door and said spring seat, and a latch bore on the other of said door and said spring seat.

10. A spring release kit for a cartridge clip, said kit being initially detached from said clip, said clip having a magazine with an ejection end and a closed end, and a compression spring positioned within said magazine, cartridges that are loaded into said magazine being spring loaded toward the ejection end of said magazine for subsequent ejection therefrom, said kit comprising a door frame initially detached from said magazine, said door frame being connectable to said magazine's closed end, an access door mounted to said door frame, said access door being slideable between open and closed positions, and said access door being slideable within a path angularly oriented relative to said compression spring's axis, a spring seat within which one end of said compressed spring is received when said kit is connected with said clip, said spring seat being telescopable through said door frame into said magazine when said door is closed and telescopable through said door frame out of said magazine when said door is open, and a drop out limit device partially carried by said door frame and partially carried by said spring seat, said drop out limit device functioning to define the telescope out position of said spring seat.

11. A spring release kit as set forth in claim 10, said drop out limit device comprising at least one lug carried by one of said spring seat and said door frame, and at least one lip carried by the other of said spring seat and said door frame, said lug and said lip interacting to restrict the telescope out position of said spring seat so as to define that spring seat's outermost position.

12. A spring release kit as set forth in claim 10, said spring seat comprising an upper seat section and a lower seat section, said upper and lower sections being telescopable relative one to the other as said spring seat moves between its inside and outside positions relative to said magazine.

13. A spring release kit as set forth in claim 12, said kit comprising a seat section limit device partially carried by said upper section and partially carried by said lower section, said seat section limit device functioning to limit the telescope out position of said seat sections relative one to the other.

14. A spring release kit as set forth in claim 13, said seat section limit device comprising at least one pin fixed to one of said two sections, and at lest one track formed in the other of said two sections, said pin and said track cooperating to guide the two sections in their telescoping movement relative one to the other.

15. A spring release kit as set forth in claim 10, said kit comprising a latch operably connected between said door and said spring seat, said latch serving to maintain said door in its closed position.

16. A spring release kit as set forth in claim 15, said latch comprising a latch detent on one of said door and said spring seat, and a latch bore on the other of said door and said spring seat.

* * * * *

UNITED STATES PATENT AND TRADEMARK OFFICE

CERTIFICATE OF CORRECTION

PATENT NO. : 5,081,778

DATED : January 21, 1992

INVENTOR(S) : Robert D. Switzer

It is certified that error appears in the above-identified patent and that said Letters Patent is hereby corrected as shown below:

Col. 1, Line 55 delete "compressed" and insert -- comprised --

Col. 5, Line 52 delete "re" and insert -- are --

Col. 6, Line 48 delete "012" and insert -- 102 --

Signed and Sealed this

Twenty-sixth Day of October, 1993

*Attest:*

Bruce Lehman

BRUCE LEHMAN

*Attesting Officer*

*Commissioner of Patents and Trademarks*